United States Patent [19]

Ciloglu et al.

[11] Patent Number: 4,927,461

[45] Date of Patent: May 22, 1990

[54] MACHINABLE-GRADE, FERROUS POWDER BLEND CONTAINING BORON NITRIDE AND METHOD THEREOF

[75] Inventors: Cavit Ciloglu, Tracy; Martin Gagne, St-Pierre de Sorel; Edy Laraque, Tracy; Joel Poirier, Sorel; Sylvain Tremblay, Jonquiere; Yves Trudel, Tracy, all of Canada

[73] Assignee: Quebec Metal Powders, Ltd., Tracy, Canada

[21] Appl. No.: 266,419

[22] Filed: Nov. 2, 1988

[51] Int. Cl.[5] ..... B22F 1/00

[52] U.S. Cl. ..... 75/254; 75/244; 75/246; 419/12; 419/23; 419/32; 419/57; 419/66; 419/39

[58] Field of Search ..... 75/254, 244, 246; 419/12, 23, 32, 57, 66, 39

[56] References Cited

U.S. PATENT DOCUMENTS

| | | | |
|---|---|---|---|
| 2,888,738 | 6/1959 | Taylor | 29/182.5 |
| 3,047,938 | 8/1962 | Dega | 29/182.3 |
| 3,451,809 | 6/1969 | Raman et al. | 75/205 |
| 4,566,905 | 1/1986 | Akashi et al. | 75/244 |

FOREIGN PATENT DOCUMENTS 0266936 5/1988 European Pat. Off. .

OTHER PUBLICATIONS

Trudel et al., Selecting Additives to Improve Machinability of Ferrous P/M Parts, Jun. '84, Int'l P/M Conf-/Exhib in Toronto.

Capus, A New Era for Iron & Steel Powders at QMP Ltd., 1987, Int'l Journal of Powder Metallurgy, vol. 23, No. 1.

Powder Metallurgy, Kirk-Othmer's Encyl. of Chem. Tech., vol. 19, 3rd Ed., pp. 28-62.

ESK Boron Nitride Powder Product Specification (Informal Copy in German).

Ullmann's, Encyclopedia of Industrial Chemistry, 5th Ed., vol. A4, 300:7.

Special Ceramics, The Preparation and Properties of Boron Nitride, 144:67.

*Primary Examiner*—Deborah Yee

*Attorney, Agent, or Firm*—Fitzpatrick, Cella, Harper & Scinto

[57] ABSTRACT

The machinability characteristics of P/M ferrous sintered compacts are improved when the compact is prepared from a ferrous powder having a maximum particle size less than about 300 microns, and from at least about 0.01 weight percent of a boron nitride powder comprising agglomerates of irregular-shaped, submicron particles.

24 Claims, No Drawings

MACHINABLE-GRADE, FERROUS POWDER BLEND CONTAINING BORON NITRIDE AND METHOD THEREOF

BACKGROUND OF THE INVENTION

1. Field of the Invention

This invention relates to ferrous powder blends. In one aspect, the invention relates to machinable-grade, ferrous powder blends containing boron nitride while in another aspect, the invention relates to the use of a boron nitride powder comprising agglomerates of irregular-shaped submicron particles.

2. Description of the Prior Art

The making and using of ferrous powders are well known, and are described in considerable detail in Kirk-Othmer's *Encyclopedia of Chemical Technology,* Third Edition, Volume 19, at pages 28–62 Ferrous powders can be made by discharging molten iron metal from a furnace into a tundish where, after passing through refractory nozzles, the molten iron is subjected to granulation by horizontal water jets. The granulated iron is then dried and reduced to a powder, which is subsequently annealed to remove oxygen and carbon. A pure iron cake is recovered and then crushed back to a powder.

Ferrous powders have many applications, such as powder metallurgy (P/M) part fabrication, welding electrode coatings, flame cutting and scarfing. For P/M applications, the iron powder is often blended with selected additives such as lubricants, binders and alloying agents, A ferrous P/M part is formed by injecting iron or steel powder into a die cavity shaped to some specific configuration, applying pressure to form a compact, sintering the compact, and then finishing the sintered compact to the desired specifications.

Shaped P/M sintered compacts often require machining as one of the finishing steps to produce the desired P/M product. Where the P/M product is a mass-produced product (for which the P/M process is well-suited), then the speed and efficiency at which these P/M products can be produced will depend in part on the speed and efficiency of the machining step. The speed and efficiency of the machining step is in turn a function of, among other things, how easily the P/M sintered compact can be cut by the machining tool. Generally, the more difficulty in cutting the P/M sintered compact, the more energy required of the cutting tool, the shorter the life of the cutting tool, and the more time required to complete the machining step.

One of the methods for increasing the speed and efficiency of the machining step is to make a P/M sintered compact with a low coefficient of friction at the interface of the cutting tool and compact, and with improved chip formation properties. This can be accomplished by blending the ferrous powder with a friction-reducing agent, such as manganese sulfide or boron nitride, but these known agents for ferrous powders while operative, are subject to improvement. For example, while all agents are admixed with the ferrous powder prior to sintering, some either adversely affect the dimensional changes that are undergone by the compact during sintering, or generally reduce the strength properties of the sintered compact, or both. A significant effect on dimensional change can require a die change by the P/M part manufacturer, which is a costly step and thus be avoided if possible. Significant reduced strength properties of the sintered compact generally reduce its ultimate usefulness These undesirable effects are a function, at least in part, of the nature and amount of agent actually added to the ferrous powder, and identifying agents that can provide the desirable effects but at lower addition levels and cost is a continuing goal of P/M research.

SUMMARY OF THE INVENTION

According to this invention, a machinable-grade, ferrous powder blend is prepared from:

A. at least about 85 weight percent of a ferrous powder having a maximum particle size less than about 300 microns; and B. at least about 0.01 weight percent boron nitride powder comprising agglomerates of irregular-shaped, submicron particles. P/M sintered compacts prepared from this ferrous powder blend demonstrate improved machinability. In addition, the boron nitride friction-reducing agent has minimal effect on both the strength of the P/M sintered compact and the dimensional changes that the compact undergoes during sintering.

DETAILED DESCRIPTION OF THE INVENTION

Essentially any ferrous powder having a maximum particle size less than about 300 microns can be used in the composition of this invention. Typical iron powders are the Atomet® iron powders manufactured by Quebec Metal Powders Limited of Tracy, Quebec, Canada. These powders have an iron content in excess of 99 weight percent with less than 0.2 weight percent oxygen and 0.1 weight percent carbon Atomet® iron powders typically have an apparent density of at least 2.50 g/cm$^3$ and a flow rate of less than 30 seconds per 50 g. While the boron nitride of this invention was found more effective in Atomet® iron powders, steel powders, including stainless and alloyed steel powders, can also be used as the ferrous powders for the blends of this invention, and Atomet® 1001, 4201 and 4601 steel powders are representative of the steel and alloyed steel powders. These Atomet® powders contain in excess of 97 weight percent iron and have an apparent density of 2.85–3.05 g/cm$^3$ and a flow of 24–28 seconds per 50 g. Atomet® steel powder 1001 is 99 plus weight percent iron, while Atomet® steel powders 4201 and 4601 each contain 0.55 weight percent molybdenum and 0.5 and 1.8 weight percent nickel, respectively. Virtually any grade of steel powder can be used. Preferably, the ferrous powder has a maximum particle size of less than about 212 microns The boron nitride powder used in this invention comprises irregular-shaped particles with an average particle size of at least about 0.05, preferably at least about 0.1 microns. As here used, "irregular-shaped particles" means not only particles like those described in FIG. 2(f) at page 32 of Kirk-Othmer's *Encyclopedia of Chemical Technology,* Third Edition, Volume 19, but also particles like those described in FIGS. 2(*c*), (*d*), (*e*), (*g*) and (*h*) of the same reference. While the particles themselves are of submicron size, they tend to bind with one another to form agglomerates ranging in size from about 5 to about 50 microns. Although not known with certainty, these agglomerates are believed to break apart when mixed with the iron particles, and the submicron particles in turn concentrate within or about the pores or crevices of the iron particles. This positioning of the boron nitride particles on the ferrous particles is believed to minimize the effect of the boron nitride on the iron particles during the sintering process and accordingly, from materially impacting the mechanical strength of the P/M compact after the sintering process. A similar effect is expected from the addition of nonagglomerated submicron boron nitride particles. The preferred average particle size of the boron nitride particles used in this invention is between about 0.2 and about 1.0 micron.

Boron nitride itself is a relatively inert material which is immiscible with iron and steel at temperatures below 1400° C. and is substantially unreactive with carbon below 1700° C. However, the hygroscopicity generally associated with boron nitride is due in large part to the presence of boric oxide, a residue from the boron nitride manufacturing process Since the shelf life of the ferrous powder blend is dependent in part upon the amount of water that is absorbed between the time the blend is formed and the time it is used to prepare a P/M sintered compact, the amount of boric oxide present in the boron nitride used to make the blends of this invention is typically less than about 5 weight percent (based on the total weight of the boron nitride), and preferably less than about 3 weight percent.

The ferrous powder blends of this invention are prepared by blending from at least about 0.01, preferably at least about 0.02 weight percent boron nitride powder with at least 85, preferably at least 90, weight percent, of a ferrous powder. Preferably, between about 0.01 and 0.10 weight percent boron nitride powder is blended with the ferrous powder, and more preferably between 0.03 and 0.07 weight percent. The blending is performed in such a manner that the resulting mixture of ferrous powder and boron nitride is substantially homogeneous. Essentially any form of mixing can be employed with conventional, mechanical mixing most typical.

The ferrous powder blend of this invention can contain other materials in addition to the ferrous and boron nitride powders. Binding agents such as polyethylene glycol, polypropylene glycol, kerosene, and the like can also be present, as well as alloying powders such as graphite, copper and/or nickel. These materials, their use and methods of inclusion in ferrous powder blends, are well known in the art.

P/M sintered compacts having improved machinability characteristics are the hallmark of this invention. These compacts are more easily machined than compacts made from ferrous powder compositions not containing boron nitride powder as here described, and thus the machining step of the P/M process exhibits greater efficiency. This advantageous feature is accomplished without any significant negative impact on the sintered properties of the ferrous powder blend.

The following examples are either illustrative embodiments of this invention or comparative examples thereof.

SPECIFIC EMBODIMENTS

Atomet® iron powder was used to study the effect of friction-reducing agent additions on the sintering properties of P/M compacts and on the strength and machinability of P/M sintered compacts. Atomet® 28 iron powder is 99+ weight percent iron and contains about 0.18 weight percent oxygen and 0.07 weight percent carbon. It has an apparent density of about 2.85 g/cm$^3$ and a flow rate of about 26 seconds per 50 g. The screen analysis (U.S. mesh) was:

| Screen Size | Weight Percent |
|---|---|
| on 100 | 5 |
| −100 +140 | 28 |
| −140 +200 | 23 |
| −200 +325 | 24 |
| −325 | 20 |

The following embodiments include representative examples of the present invention (Example 1), Comparative examples using manganese sulfide and boron nitride (Comparative Examples 1–3) and a control which does not have a friction-reducing agent.

COMPARATIVE EXAMPLE 1

The manganese sulfide (MnS) friction-reducing agent used in these examples comprised nonagglomerated particles having an average particle size of about 5 microns.

Three grades of boron nitride (BN) friction-reducing agent were also used.

COMPARATIVE EXAMPLE 2

The first grade (BN-I) comprised 5–10 ron agglomerates of plate-like particles having an average particle size of 0.5–1 micron. This grade of boron nitride also contained between about 0.2 and about 0.4 weight percent boric oxide.

COMPARATIVE EXAMPLE 3

The second grade (BN-II) comprised nonagglomerated plate-like particles of 5–15 microns, and contained a maximum of about 0.5 weight percent boric oxide.

EXAMPLE 1

The third grade (BN-III), like the first grade, also comprised 5–30 micron agglomerates of particles having an average particle size of 0.05–1 micron. These particles had a nonplatelet or irregular shape as opposed to the platelet shape of the first-grade used in comparative Example 2. The boric oxide content of BN-III was between about 0.5 and about 3 weight percent.

In the above specific embodiments, Atomet® 28 iron powder was first blended with about 0.5 weight percent zinc stereate (a lubricant) and varying levels of graphite ranging from 0 through 0.9 weight percent. Various amounts of the friction-reducing agent were then added to aliquots of the blend and then mechanically mixed to form a substantially homogeneous mixture (within 5% of the addition level). Test pieces were compacted at 6.7 g/cm$^3$ and then sintered for 30 minutes at 1120° C. in a rich endothermic atmosphere. Sintered properties were measured on standard transverse rupture bars in accordance with Metal Powder Industries Federation test methods.

Machinability was evaluated using the drilling thrust force test. General purpose twist steel drills were inserted in the rotating head of an industrial lathe and fed into the specimens mounted on a load cell. Thrust forces were measured on test bars measuring 31.8 mm by 12.7 mm by 12.7 mm compacted and sintered according to the above-described procedures. Two holes of 6.4 mm diameter and 10 mm deep were drilled in each specimen. No coolant was used during the drilling operation and the penetration rate was fixed at 40 mm/min and the speed of the drill at 800 rpm for all tests. The thrust forces were measured by the load cell and recorded on a high speed plotter The thrust force was used as a machinability index of the sintered parts and the lower the thrust force, the better the machinability (longer cutting tool life, less cutting tool power requirements, and less time required to machine the sintered compact).

The results of these tests are reported in the following Table, wherein the reported values are averages of at least three measurements. Such results demonstrate that the addition of any of the reported friction-reducing agents had a positive effect on the reduction of thrust force. However, the amount of agent required for obtaining any given level of thrust force reduction varied with the agent, and the negative effect on the strength, dimensional change and hardness of the compact also varied with the agent and the amount of it used.

For example, 0.5 weight percent of MnS provided a 10 percent reduction in thrust force for a compact made from a blend containing 0.9 weight percent graphite, but it also reduced its TRS (by 15 percent) and hardness (from 77 to 74), and caused more dimensional change (+0.1 percent). Better results were obtained by using significantly less BN-I and BN-II Both of these agents reduced the thrust force by at least 17 percent while reducing the TRS and hardness less than or about the same as did the use of MnS at the 0.5 weight percent addition level. The use of BN-I (Comparative Example 2) and II (Comparative Example 3) at these lower addition levels (0.1, 0.2 and 0.3 weight percent) also resulted in less dimensional change.

The use of BN-III (Example 1 ) results in a very positive thrust force reduction (23 percent) at an addition level (0.05) almost an order of magnitude less than that required for similar results from BN-I and II. In addition, the reduction in TRS (7.1 percent) and hardness (77 to 74) and the impact on dimensional change (+0.01) are virtually the same. Greater thrust force reductions (61 percent) can be achieved by using more BN-III (0.3 weight percent) but at the expense of greater reduction in TRS (43 percent) and hardness (77 to 54), and impact on dimensional change (−0.04). However these trade-offs exist for the other agents as well (compare the 0.1 and 0.2 levels of BN-II). Accordingly, by using the friction-reducing agent of this invention (BN-III), considerably less agent can be used while still obtaining desirable machinability characteristics without increasing the trade-offs in the reduction of mechanical strength, hardness or exaggerated dimensional change. Thus, even though the addition levels of BN-III are less than those of BN-I and BN-II, the greater number of particles per unit of weight in BN-III is believed to result in the more continuous chip-breaking effect and the greatest degree of lubricity observed at the chip-tool interface

TABLE

EFFECTS OF FRICTION-REDUCING AGENTS ON THE PROPERTIES OF ATOMET ® 28 SINTERED COMPACTS

| Agent | Weight % Addition level | Weight % Graphite added | TRS % Red.[1] | % D.C.[2] | Hardness[3] ($R_B$) | % Reduction Thrust Force |
|---|---|---|---|---|---|---|
| None | — | 0.3 | — | 0 | 51 | 0 |
| (control) | | 0.6 | — | 0 | 66 | 0 |
| | | 0.9 | — | 0 | 77 | 0 |
| MnS | 0.5 | 0.3 | 13 | +0.10 | 52 | 23 |
| (Comparative Example 1) | | 0.6 | 11 | +0.11 | 65 | 18 |
| | | 0.9 | 15 | +0.10 | 74 | 10 |
| BN-I | 0.1 | 0.9 | 2.6 | +0.02 | 76 | 4 |
| (Comparative Example 2) | 0.2 | 0.3 | 2.1 | +0.03 | 51 | 21 |
| | | 0.6 | 0.8 | +0.01 | 68 | 19 |
| | | 0.9 | 2.5 | −0.01 | 76 | 17 |
| BN-II | 0.1 | 0.9 | 10.3 | +0.04 | 77 | 21 |
| (Comparative Example 3) | 0.3 | 0.9 | 16.3 | +0.04 | 73 | 36 |
| BN-III | 0.02 | 0.9 | 0.8 | −0.01 | 75 | 3.5 |
| (Example I) | 0.05 | 0.3 | 1.9 | 0 | 46 | 15 |
| | | 0.6 | 1.5 | −0.03 | 59 | 19 |
| | | 0.9 | 7.1 | +0.01 | 74 | 23 |
| | 0.1 | 0.6 | 7.1 | +0.03 | 59 | 30 |
| | | 0.9 | 12.3 | +0.03 | 70 | 28 |
| | 0.2 | 0.6 | 15 | +0.04 | 60 | 47 |
| | | 0.9 | 38 | 0 | 62 | 46 |
| | 0.3 | 0.9 | 43 | −0.04 | 54 | 61 |
| | 0.5 | 0.6 | 36.6 | −0.10 | 53 | 61 |

[1]Transverse Rupture Strength, percent differential from standard
[2]Dimensional Change, percent differential from standard
[3]Rockwell$_B$ While this invention has been described with specific reference to particular embodiments, these embodiments are for the purpose of illustration only and are not intended as a limitation upon the scope of the following claims.

What is claimed is:

1. A powder metallurgy blend comprising:

from about 85 to about 99.99 weight percent of a ferrous powder having a maximum particle size of less than about 300 microns; and from about 0.0I to about 0 5 weight percent boron nitride powder comprising irregularly-shaped submicron particles of about 1 micron or less.

2. The powder blend of claim 1 where the maximum particle size of the ferrous powder is less than about 212 microns.

3. The powder blend of 1 where the ferrous powder comprises at least about 90 weight percent of the blend.

4. The powder blend of claim 1 where the boron nitride comprises at least about 0.02 weight percent of the blend.

5. The powder blend of claim 3 where the boron nitride powder comprises between about 0.02 and 0.1 weight percent of the blend.

6. The powder blend of claim 5 where the boron nitride powder contains less than about 5 weight percent boric oxide.

7. The powder blend of claim 5 where the boron nitride powder contains less than about 3 weight percent boric oxide.

8. The powder blend of claim 7 where the submicron particles of boron nitride have an average particle size between about 0.05 and 1.0 micron.

9. The powder blend of claim 8 where the submicron particles of boron nitride have an average particle size between about 0.1 and 1 micron.

10. A ferrous shape made from compacting the powder blend of claim any of claims 1–9.

11. The powder blend of any of claims 2–5, where the submicron particles of boron nitride have an average particle size between about 0.2 and 1 micron.

12. The powder blend of claim 11 where the boron nitride powder comprises between about 0.03 and 0.07 weight percent of the blend.

13. The powder blend of any of claims 1–3, where the ferrous powder is a steel powder 14. The powder blend of claim 13, where said steel powder is a stainless steel powder.

15. The powder blend of any of claims 1–5, further comprising at least one alloying powder selected from the group consisting of graphite, copper and nickel.

16. A process for producing a powder composition for use in fabricating a ferrous part, comprising the steps of:

selecting a ferrous powder having a maximum particle size of less than about 300 microns;

selecting a boron nitride powder comprising irregularly-shaped submicron particles of less than about 1 micron; and blending said boron nitride powder with the ferrous powder to make a mixture of said powders, said mixture comprising from about 85 to about 99.99 weight percent of ferrous powder and from about 0.01 to about 0.5 weight percent of said boron nitride powder.

17. The process for producing a powder composition of claim 16, including the step of selecting agglomerates of said boron nitride particles as said boron nitride powder.

18. A process for producing a powder composition of claim 17, wherein said boron nitride powder particle agglomerates are from about 5 to about 50 microns.

19. A process for producing a powder composition of claim 18, wherein the agglomerates are less than about 30 microns.

20. An improved process for fabricating a ferrous part by applying pressure to a ferrous powder within a cavity, the improvement comprising:

utilizing as said mixture a composition comprising from about 85 to about 99.99 weight percent of a ferrous powder having a maximum particle size less than about 300 microns and from about 0.01 to about 0.5 weight percent of a boron nitride powder comprising irregularly-shaped particles of less than about 1 micron.

21. A method for improving the machinability of powder metallurgy using boron nitride, comprising the steps of:

selecting a boron nitride powder comprising irregularly-shaped particles of less than about 1 micron;

selecting a ferrous powder having a maximum particle size less than about 300 microns;

blending said boron nitride powder with the ferrous powder to make a mixture of said powders, said mixture comprising from about 85 to about 99.99 weight percent of ferrous powder and from about 0.01 to about 0.5 weight percent of said boron nitride powder; and producing a sintered compact of said mixture.

22. A method of improving the machinability of powder metallurgy of claim 20, including the step of selecting agglomerates of said boron nitride particles as said boron nitride powder.

23. A method for improving the machinability of powder metallurgy of claim 21, wherein said boron nitride powder particle agglomerates are from about 5 to about 50 microns.

24. A method for improving the machinability of powder metallurgy of claim 23, wherein the agglomerates are less than about 30 microns.

* * * * *

UNITED STATES PATENT AND TRADEMARK OFFICE

CERTIFICATE OF CORRECTION

PATENT NO. : 4,927,461

DATED : May 22, 1990

INVENTOR(S) : CAVIT CILOGLU ET AL.

It is certified that error appears in the above-identified patent and that said Letters Patent is hereby corrected as shown below:

COLUMN 6

Line 64, "nitride" should read --nitride powder--.

COLUMN 8

Line 10, "powder" should read --powder mixture--.

Signed and Sealed this

Second Day of March, 1993

*Attest:*

STEPHEN G. KUNIN

*Attesting Officer*

*Acting Commissioner of Patents and Trademarks*